US008845049B2

(12) United States Patent
Chiba

(10) Patent No.: US 8,845,049 B2
(45) Date of Patent: Sep. 30, 2014

(54) PRINTING DEVICE AND METHOD FOR CONTROLLING PRINTING DEVICE

(71) Applicant: Seiko Epson Corporation, Tokyo (JP)

(72) Inventor: Takumi Chiba, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/850,771

(22) Filed: Mar. 26, 2013

(65) Prior Publication Data

US 2013/0257934 A1 Oct. 3, 2013

(30) Foreign Application Priority Data

Mar. 28, 2012 (JP) ..... 2012-073230

(51) Int. Cl.
*B41J 2/195* (2006.01)

(52) U.S. Cl.
USPC ..... 347/7; 347/5; 347/6

(58) Field of Classification Search
USPC ..... 347/5, 6, 7, 9, 14, 19
See application file for complete search history.

(56) References Cited

U.S. PATENT DOCUMENTS

2002/0140748 A1* 10/2002 Kanaya et al. ..... 347/7
2003/0210289 A1* 11/2003 Yoshiyama et al. ..... 347/7

FOREIGN PATENT DOCUMENTS

JP 2003-019814 A 1/2003

* cited by examiner

*Primary Examiner* — Lam S Nguyen
(74) *Attorney, Agent, or Firm* — Global IP Counselors, LLP

(57) ABSTRACT

In a case where a forcible detection execution flag is set to ON, the end position of the CR movement is changed and the acquiring range of the detection value "Is" is changed such that the movable range of the carriage is enlarged to a range that makes detection of an ink remaining amount by the ink sensor possible. Then, a print process for forcible detection is conducted in which the printing head and the carriage motor are controlled such that the printing head ejects ink while the carriage is moving in the enlarged movable range. Consequently, in a case where the forcible detection is requested, the ink remaining amount in the ink cartridge installed in the carriage can be detected regardless of the printing area based on the print data.

10 Claims, 12 Drawing Sheets

PRINTING DEVICE AND METHOD FOR CONTROLLING PRINTING DEVICE

CROSS-REFERENCE TO RELATED APPLICATIONS

This application claims priority to Japanese Patent Application No. 2012-073230 filed on Mar. 28, 2012. The entire disclosure of Japanese Patent Application No. 2012-073230 is hereby incorporated herein by reference.

BACKGROUND

1. Technical Field

The present invention relates to a printing device in which printing is conducted by ejecting ink from a printing head to a medium based on print data, and a method for controlling the printing device.

2. Background Technology

As this type of printing device, a printing device which has a printing head for ejecting ink, an ink cartridge for supplying ink to the printing head, a carriage for installing the printing head and the ink cartridge and moving in a main scanning direction, and an ink sensor provided in a substantially central position of a movable range of the carriage in the main scanning direction separately from the carriage has been proposed, in which printing is conducted by ejecting ink from the printing head to paper while moving the carriage in the main scanning direction for each pass (for example, see Patent Document 1). In this device, when the ink cartridge faces the ink sensor in accordance with the movement of the carriage during the pass, an ink remaining amount in the ink cartridge is detected by the ink sensor.

Japanese Laid-open Patent Publication No. 2003-19814 (Patent Document 1) is an example of the related art.

SUMMARY

Problems to Be Solved by the Invention

In such a printing device, however, if the printing area is limited to part of paper, the movement of the carriage during the pass will possibly be limited to the part. In such a case, the above-described ink sensor provided in the substantially central position of the movable range cannot detect the ink remaining amount because it does not face the ink cartridge during the pass. On the other hand, in order to make detection of the ink remaining amount possible even in such a case, a plurality of ink sensors can be provided in the main scanning direction. However, this results in cost increases because the number of the sensor increases. Such detection of the ink remaining amount is important to make the print quality stable, and thus reliable detection of the ink remaining amount is needed even in a case where the printing area deviates from the detection range of the ink sensor.

Means Used to Solve the Above-Mentioned Problems

The main advantage of the printing device and the method for controlling the printing device of the invention is to detect an ink remaining amount even in a case where a printing area deviates from a range in which detection of the ink remaining amount is possible.

In order to achieve the above-described main advantage, the printing device and the method for controlling the printing device of the invention are configured as follows.

According to the invention, a printing device in which printing is conducted by ejecting ink from a printing head to a medium based on print data includes a carriage that installs the printing head and an ink cartridge for storing ink, a moving section that moves the carriage in a main scanning direction, an ink remaining amount detecting section that can detect an ink remaining amount in the ink cartridge when the carriage moves in a part of a movable range of the carriage in the main scanning direction, the ink remaining amount detecting section being provided spaced apart from the carriage in the movable range of the carriage in the main scanning direction, a remaining amount detection requesting section that makes a request for detection of an ink remaining amount in the ink cartridge by the ink remaining amount detecting section in a case where predetermined detection conditions are met, and a print processing section that conducts a print process for detection of an ink remaining amount in which the movable range of the carriage in the main scanning direction based on the print data is enlarged to a range including the part of the movable range so as to make detection of an ink remaining amount possible, and the printing head and the moving section are controlled such that the printing head ejects ink while the carriage is moving in the enlarged movable range in a case where a request for detection of an ink remaining amount is made.

With this printing device, a request for detection of an ink remaining amount in the ink cartridge by the ink remaining amount detecting section is made in a case where predetermined detection conditions are met. Then, a print process for detection of an ink remaining amount is conducted in which the movable range of the carriage in the main scanning direction based on the print data is enlarged to a range including the part of the movable range so as to make detection of an ink remaining amount possible, and the printing head and the moving section are controlled such that the printing head ejects ink while the carriage is moving in the enlarged movable range in a case where a request for detection of an ink remaining amount is made. Consequently, in a case where a request for detection of an ink remaining amount is made, since the carriage is moved including a range in which detection of an ink remaining amount by the ink remaining amount detecting section is possible, the ink remaining amount can be detected regardless of the print data. As a result, even in a case where the printing area deviates from the range in which detection of an ink remaining amount is possible, the ink remaining amount can be detected.

The printing device of the invention can include a delivering section that delivers the medium in a sub scanning direction. When ejection of ink from the printing head is finished in a predetermined print pass, the print processing section can serve to control the delivering section so as to deliver the medium for a next print pass even while the carriage is moving. With this configuration, since delivery of the medium by the delivering section and detection of an ink remaining amount by the ink remaining amount detecting section can be conducted at the same time, a print process for detection of an ink remaining amount can be efficiently conducted compared to the case where the medium is delivered after the carriage stops. Consequently, when a print process for detection of an ink remaining amount is conducted, throughput of printing can be prevented from being greatly deteriorated.

In the printing device of the invention, the remaining amount detection requesting section can make a request for detection of an ink remaining amount by determining that the predetermined detection conditions are met in a case where a predetermined number of print passes are continued in a state where detection of an ink remaining amount by the ink remaining amount detecting section is not conducted. With this configuration, problems can be prevented from being caused by continuing printing beyond a predetermined number of print passes without detecting an ink remaining amount, and thus, stable print quality can be achieved.

In the printing device of the invention, the remaining amount detection requesting section can increase frequency of making a request for detection of an ink remaining amount in a case where the ink remaining amount detected by the ink remaining amount detecting section is below a predetermined threshold value. With this configuration, since the frequency of detection of an ink remaining amount can be increased in a case where the ink remaining amount is small, stable print quality can further be achieved. Here, the predetermined threshold value can be set to a value obtained by adding a slight margin to a threshold value in which ink in the ink cartridge is determined to be empty.

In the printing device of the invention, the print processing section can control the moving section such that the carriage moves at least in the part of the movable range at a predetermined timing from completion of printing to a previous medium until start of printing to a next medium. Further, the remaining amount detection requesting section can stop a request for detection of an ink remaining amount during the printing to a next medium regardless of whether the predetermined detection conditions are met or not when it is expected that the ink remaining amount will not fall below a predetermined threshold value during the printing to a next medium based on the ink remaining amount detected by the ink remaining amount detecting section at the predetermined timing. With this configuration, throughput of printing can be prevented from being deteriorated by conducting a print process for detection of an ink remaining amount in a case where there is no need to detect an ink remaining amount.

In the printing device of the invention, the remaining amount detection requesting section can cancel a request for detection of an ink remaining amount in a case where the ink remaining amount is detected by the ink remaining amount detecting section after the request is made. Further, the print processing section can conduct control of printing for detection of an ink remaining amount by enlarging the movable range of the carriage in a print pass to a range including the part of the movable range until a request for detection of an ink remaining amount is cancelled in a case where the request is made in bidirectional printing. With this configuration, the motion of the carriage can be made stable and an ink remaining amount can be securely detected in bidirectional printing. Here, in bidirectional printing, the print processing section can enlarge the movable range of the carriage by changing an end position of the movement of the carriage in a print pass into a position on a far side of a movement direction of the carriage until a request for detection of an ink remaining amount is cancelled. With this configuration, control of printing for detection of an ink remaining amount is conducted after the end position of the movement is uniformly changed. Therefore, the motion of the carriage can be made stable compared to the case where the end position of the movement is changed in a print pass depending on whether an ink remaining amount is detected or not.

In the printing device of the invention, the remaining amount detection requesting section can cancel a request for detection of an ink remaining amount in a case where the ink remaining amount is detected by the ink remaining amount detecting section after the request is made. Further, the print processing section can conduct control of printing for detection of an ink remaining amount by enlarging the movable range of the carriage in a print pass to a range including the part of the movable range until a request for detection of an ink remaining amount is cancelled in a case where the request is made in unidirectional printing. With this configuration, the motion of the carriage can be made stable and an ink remaining amount can be securely detected in unidirectional printing. Here, in unidirectional printing, the print processing section can enlarge the movable range of the carriage by changing an end position of the movement of the carriage in a print pass into a position on a far side of a movement direction of the carriage and changing a start position of the movement of the carriage into a position on a near side of the movement direction of the carriage until a request for detection of an ink remaining amount is cancelled. With this configuration, control of printing for detection of an ink remaining amount is conducted after the end position of the movement and the start position of the movement are uniformly changed. Therefore, the motion of the carriage can be made stable compared to the case where the end position of the movement and the start position of the movement are changed in a print pass depending on whether an ink remaining amount is detected or not.

In the printing device of the invention, printing can be conducted to a plurality of kinds of mediums having different sizes, and the ink remaining amount detecting section can be provided in a position that is a substantially central position in the main scanning direction of a medium having the smallest width in the main scanning direction among the plurality of kinds of mediums. Since this configuration increases the likelihood that an ink remaining amount is detected in a normal print pass, the frequency of conducting control of printing for detection of an ink remaining amount can be made low.

A method for controlling a printing device of the invention is a method for controlling a printing device including a carriage that installs a printing head and an ink cartridge for storing ink, a moving section that moves the carriage in a main scanning direction, and an ink remaining amount detecting section that can detect an ink remaining amount in the ink cartridge when the carriage moves in a part of a movable range of the carriage in the main scanning direction, the ink remaining amount detecting section being provided spaced apart from the carriage in the movable range of the carriage in the main scanning direction, in which printing is conducted by ejecting ink from the printing head to a medium based on print data. The method includes a step (a) of making a request for detection of an ink remaining amount in the ink cartridge by the ink remaining amount detecting section in a case where predetermined detection conditions are met, and a step (b) of conducting a print process for detection of an ink remaining amount in which the movable range of the carriage in the main scanning direction based on the print data is enlarged to a range including the part of the movable range so as to make detection of an ink remaining amount possible, and the printing head and the moving section are controlled such that the printing head ejects ink while the carriage is moving in the enlarged movable range in a case where a request for detection of an ink remaining amount is made by the step (a).

With this method for controlling a printing device of the invention, a request for detection of an ink remaining amount in the ink cartridge by the ink remaining amount detecting section is made in a case where predetermined detection conditions are met. Then, a print process for detection of an ink remaining amount is conducted in which the movable range of the carriage in the main scanning direction based on the print data is enlarged to a range including the part of the movable range so as to make detection of an ink remaining amount possible, and the printing head and the moving section are controlled such that the printing head ejects ink while the carriage is moving in the enlarged movable range in a case where a request for detection of an ink remaining amount is made. Consequently, in a case where a request for detection of an ink remaining amount is made, since the carriage is moved including a range in which detection of an ink remaining amount by the ink remaining amount detecting section is possible, the ink remaining amount can be detected regardless of the print data. As a result, even in a case where the printing area deviates from a detection range of an ink sensor for detecting an ink remaining amount, the ink remaining amount can be detected. Here, a step can be added to achieve any one of functions of the printing device as descried above.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
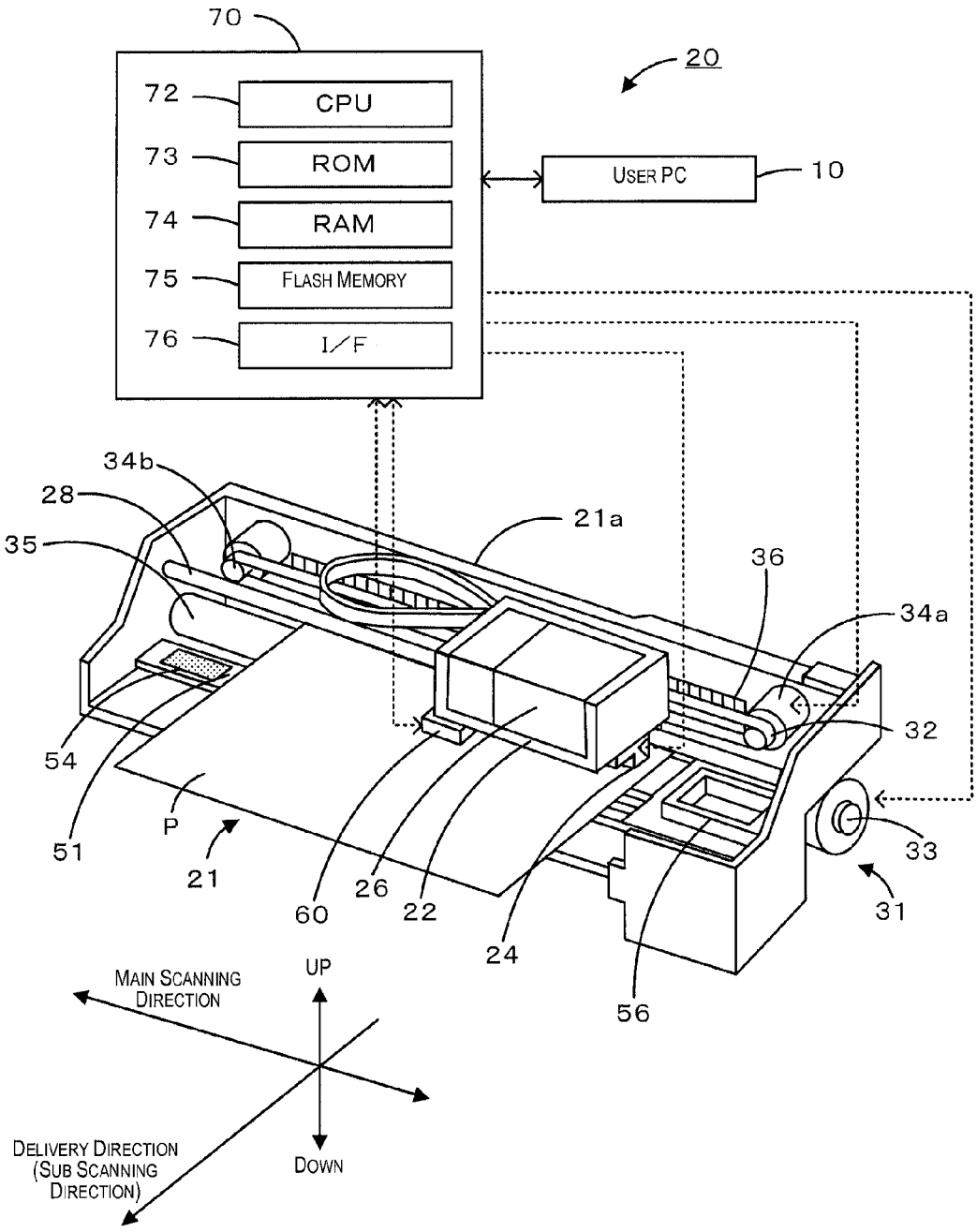
FIG. 1 is a configuration diagram that schematically illustrates a configuration of an ink-jet printer 20.

Hereinafter, embodiments of the invention will be described with reference to the drawings. FIG. 1 is a configuration diagram that schematically illustrates a configuration of the ink-jet printer 20 that is an embodiment of the printing device of the invention. The ink-jet printer 20 of the present embodiment has a paper feeding mechanism 31, a printer mechanism 21, a flushing region 54, a capping device 56, and a controller 70 as shown in the drawing. The paper feeding mechanism 31 delivers paper P in a delivery direction (sub scanning direction) shown in the drawing by driving a paper feeding roller 35 with a paper feeding motor 33. The printer mechanism 21 conducts printing by ejecting ink drops from a printing head 24 to paper P delivered on a platen 51 by the paper feeding mechanism 31. The flushing region 54 is provided on the left side of the platen 51 to receive ink flushed from the printing head 24. The capping device 56 is provided on the right side of the platen 51 to seal the printing head 24 so as to prevent the printing head 24 from becoming dry while printing is not conducted. The controller 70 controls the entire ink-jet printer 20. A position on the capping device 56 is referred to as a home position. The ink-jet printer 20 of the present embodiment can use a plurality of kinds of paper having different sizes such as A4 paper, B5 paper, postcard, or L size as paper P. Such paper P is fed (delivered) by so-called center paper feeding in which paper is fed using the center of the paper as the reference regardless of the size.

The printer mechanism 21 has a carriage motor 34*a*, a driven roller 34*b*, a carriage belt 32, the carriage 22, an ink cartridge 26, the printing head 24, and the ink sensor 60. The carriage motor 34*a* is provided on the right side of a mechanical frame 21*a*, and the driven roller 34*b* is provided on the left side of the mechanical frame 21*a*. The carriage belt 32 is provided so as to bridge over the carriage motor 34*a* and the driven roller 34*b*. The carriage 22 moves back and forth in a main scanning direction along a guide 28 by the carriage belt 32 in accordance with driving of the carriage motor 34*a*. The ink cartridge 26 is loaded in the carriage 22, and separately stores ink of each color of cyan (C), magenta (M), yellow (Y), and black (K) which contain a dye or a pigment as a colorant in water as a solvent. The printing head 24 ejects ink drops supplied from the ink cartridge 26. The ink sensor 60 for detecting an ink remaining amount is fixed to a fixing member, that is not shown in the drawing, extending from the mechanical frame 21*a*. A linear encoder 36 is provided on a back surface of the carriage 22 to output a pulsed signal in accordance with movement of the carriage 22, and the position of the carriage 22 is controlled by the linear encoder 36. In the following explanations or the drawings, the carriage 22 is also referred to as "CR" and the ink sensor 60 is also referred to as "S".

Figure 2:
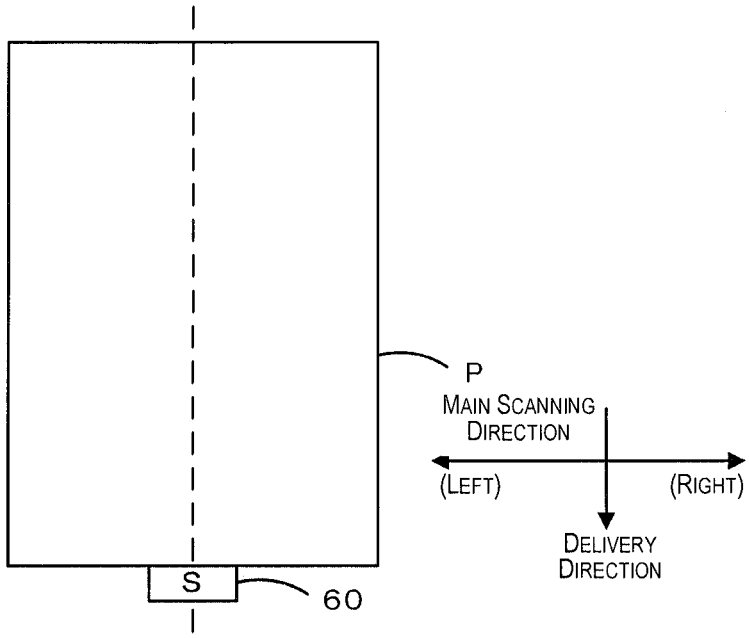
FIG. 2 is a diagram that explains an arrangement of an ink sensor 60 by a positional relationship with respect to paper P.
Figure 3:
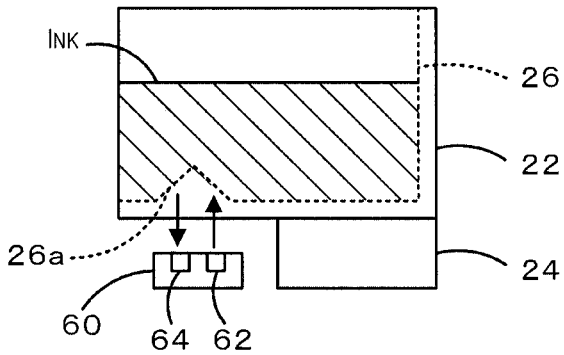
FIG. 3 is a diagram that explains an arrangement of the ink sensor 60 by a positional relationship with respect to a carriage 22.

FIG. 2 is a diagram that explains the arrangement of the ink sensor 60 by the positional relationship with respect to the paper P. FIG. 3 is a diagram that explains the arrangement of the ink sensor 60 by the positional relationship with respect to the carriage 22. As shown in FIG. 2, the ink sensor 60 is arranged in a substantially central position of the delivered paper P. The paper P is fed by center paper feeding regardless of the size as described above, which means that the ink sensor 60 is arranged in a substantially central position of the paper P regardless of the size of the paper P. Also, as shown in FIG. 3, the ink sensor 60 is arranged below the ink cartridge 26 loaded in the carriage 22. The ink sensor 60 has a light emitting element 62 that emits light upward, and a light receiving element 64 that receives light from above. The ink sensor 60 is configured as a so-called reflective type photoelectric sensor for outputting an electrical signal that is obtained by converting into a voltage corresponding to a light reception amount of the light receiving element 64. On the other hand, the ink cartridge 26 is formed of a light transmissive synthetic resin material, and a recessed portion 26*a* having a cross-section of a triangular shape is formed in a lower surface of the ink cartridge 26. When the ink sensor 60 faces the recessed portion 26*a* of the ink cartridge 26 while the carriage 22 is moving through a substantially central portion of the paper P that is a part of a movable range of the carriage 22 during printing or the like, light emitted from the light emitting element 62 and reflected on the recessed portion 26*a* (an inclined surface of the recessed portion 26*a*) of the ink cartridge 26 can be received by the light receiving element 64. Light reflected on the recessed portion 26*a* of the ink cartridge 26 is changed depending on an ink remaining amount as well as the refractive index of the synthetic resin material, the incident angle of the light, and the angle of the inclined surface. Although the details are not explained, when the ink remaining amount is sufficient, for example, most of the incident light is transmitted from the recessed portion 26*a* into the ink cartridge 26, and reflected light becomes small. Once the ink remaining amount decreases and the liquid level reaches the recessed portion 26*a*, as the ink remaining amount decreases and the liquid level gets lower, the amount of light transmitted into the ink cartridge 26 decreases and more light is reflected. In this manner, the amount of light reflected on the recessed portion 26*a* changes depending on the ink remaining amount, and thus the light reception amount of the light receiving element 64 changes accordingly. Therefore, when the carriage 22 passes through a substantially central portion of the paper P, the ink sensor 60 outputs an electrical signal corresponding to the ink remaining amount of the ink cartridge 26 of each color because reflected light of light emitted from the light emitting element 62 is received by the light receiving element 64. Hereinafter, this electrical signal is referred to as a detection value "Is" of an ink remaining amount.

The controller 70 is configured as a microprocessor centered on a CPU 72, and includes a ROM 73, a RAM 74, a flash memory 75, an interface (I/F) 76, and an input-output port. The input-output port is not shown in the drawing. The ROM 73 stores various kinds of processing programs or various kinds of data. The RAM 74 temporarily stores data. The flash memory 75 can write and delete data. The interface (I/F) 76 exchanges information with an external device. A print buffer region is provided in the RAM 74, and a print job is stored in the print buffer region. The print job is sent from a user PC 10, that is a general-purpose personal computer, through the I/F 76. A position signal from the linear encoder 36, the detection value "Is" from the ink sensor 60, and the like are input to the controller 70 through an input port. Also, a driving signal to the printing head 24, a driving signal to the paper feeding motor 33, a driving signal to the carriage motor 34*a*, and the like are output from the controller 70 through an output port.

In the ink-jet printer 20 of the present embodiment configured in this manner, when the ink-jet printer 20 receives print data generated in the user PC 100 as a print job, the received print data is decompressed in the print buffer region provided in the RAM 74, and the paper P is delivered on the platen 51 to be fed by rotation of the paper feeding roller 35 driven by the paper feeding motor 33. Then, the printing head 24 and the carriage motor 34*a* are driven such that ink is ejected from the printing head 24 while the carriage 22 is moving in a movement range in the main scanning direction based on one pass of print data, and the paper P is delivered for one pass through rotation of the paper feeding roller 35 every time printing is finished (hereinafter, referred to as a normal print process). Printing is conducted to the paper P by repeating this normal print process, and the paper P is discharged by rotation of the paper feeding roller 35 when printing for one sheet of the paper P is finished.

In the normal print process, the controller 70 drives the printing head 24 to eject ink of each color while the carriage 22 is moving on a printing area based on print data, and stops driving the printing head 24 when the carriage 22 reaches an end position of the printing area (head driving stop position). Also, the controller 70 controls the carriage motor 34*a* such that the carriage 22 is accelerated from a stop state and then is moved at a substantially constant speed within a printing area, and the carriage 22 is decelerated and then is stopped when driving of the printing head 24 is stopped. Therefore, in the normal print process, the movement range of the carriage 22 (CR movement range) from a CR movement start position in which the carriage 22 starts movement to a CR movement end position in which the carriage 22 ends (stops) movement can be determined based on a printing area and a range needed for acceleration and deceleration. Also, the detection value "Is" of the ink sensor 60 can be acquired while the carriage 22 is moving in a substantially central portion of the paper P, and it is configured that the detection value "Is" is acquired using the printing area as an acquiring range in the normal print process. Therefore, the detection value "Is" is continuously input to the controller 70 while the carriage 20 is moving in the printing area including a case where the ink cartridge 26 does not face the ink sensor 60.

Figure 4:
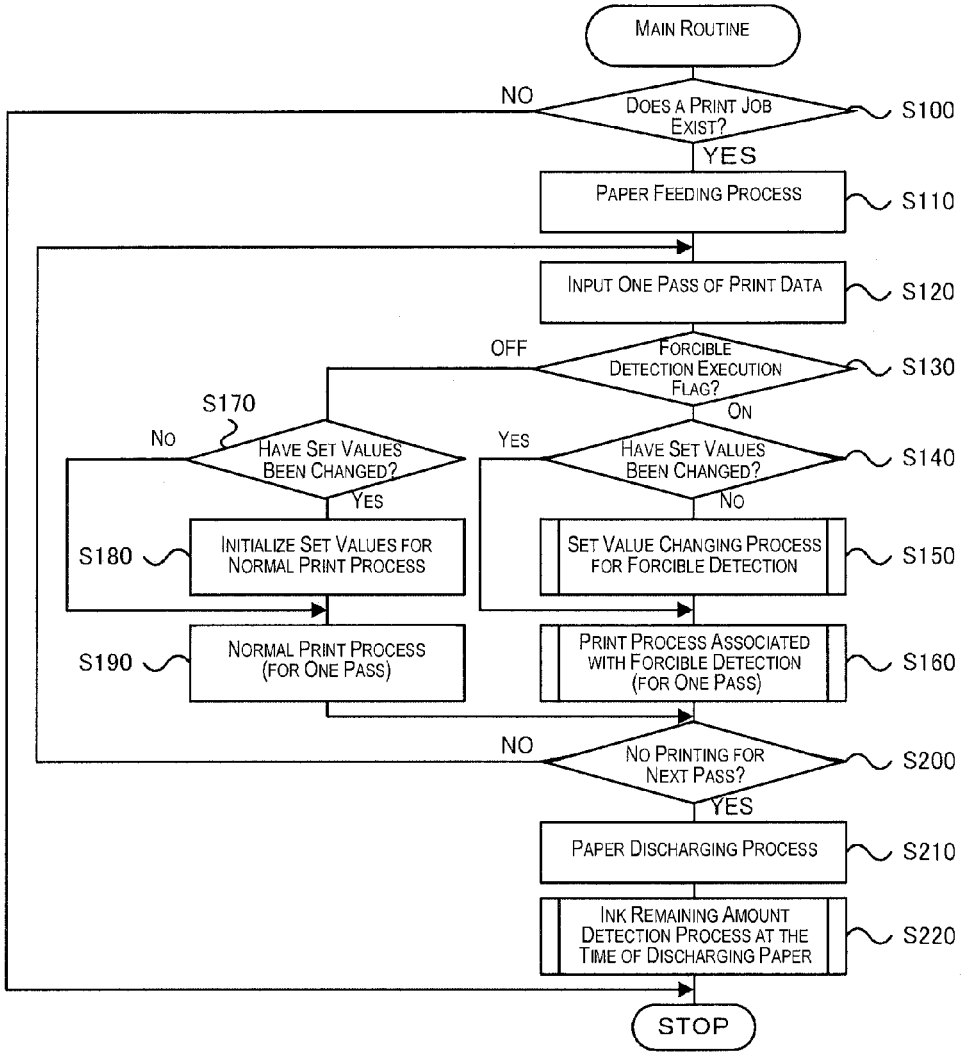
FIG. 4 is a flow chart that shows an example of a main routine.

Next, the operation of the ink-jet printer 20 of the present embodiment configured in this manner will be explained. FIG. 4 is a flow chart that shows an example of a main routine executed by the controller 70. This routine is executed after the power of the ink-jet printer 20 is turned on and a start process is finished.

When this main routine is executed, the CPU 72 of the controller 70 determines whether or not a print job that is waiting for printing exists in a print buffer region provided in the RAM 74 (step S100). When it is determined that there is no print job, this routine is finished. This routine is executed again when a predetermined period of time (for example, several milliseconds or several tens milliseconds) passes after being finished. When it is determined that there is a print job in step S100, a paper feeding process is conducted to feed the paper P by rotation of the paper feeding roller 35 through the paper feeding motor 33 (step S110), and one pass of print data is input (step S120). Next, ON and OFF of a forcible detection execution flag are checked (step S130). The forcible detection execution flag is a flag for forcibly detecting an ink remaining amount in the ink cartridge 26 by the ink sensor 60.

Figure 5:
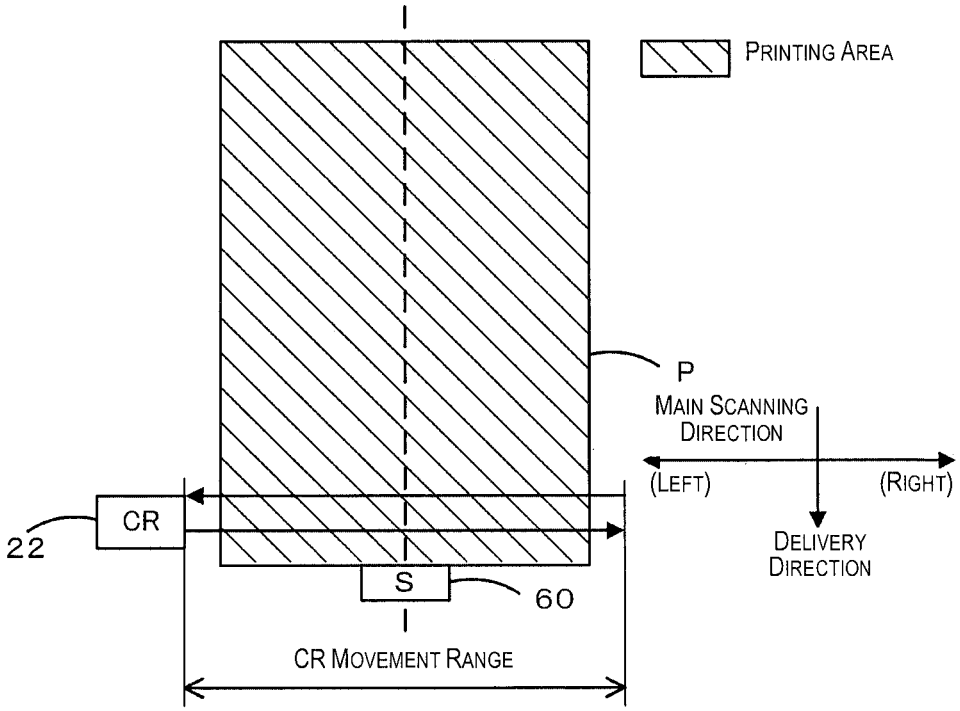
FIG. 5 is a diagram that explains an example of a relationship between a printing area and a CR movement range.
Figure 6:
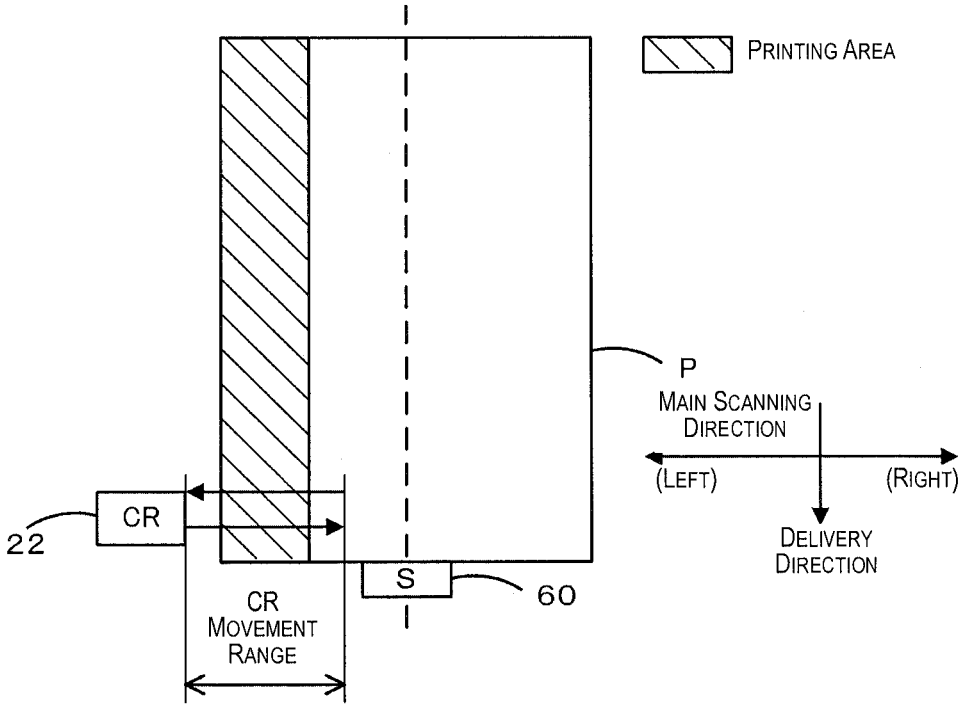
FIG. 6 is a diagram that explains an example of a relationship between a printing area and a CR movement range.

Here, the forcible detection execution flag is set in a setting process of a forcible detection execution flag, executed separately from the main routine, as a flag for determining whether or not forcible detection of an ink remaining amount is to be conducted. The setting process of the forcible detection execution flag will be described later, and the forcible detection will be explained here. FIG. 5 and FIG. 6 are diagrams that explain examples of the relationship between the printing area and the CR movement range. FIG. 5 shows the CR movement range in a case where the printing area is an entire region (entire width) of the paper P, and FIG. 6 shows the CR movement range in a case where the printing area is limited to a part (a part of the width) of the paper P. As described above, in the normal print process for one pass, the CR movement range is a range in accordance with the printing area, and the acquiring range of the detection value "Is" of the ink sensor 60 is set to the printing area. In the case of FIG. 5, therefore, the detection value "Is" that includes the ink remaining amount of the ink cartridge 26 can be acquired in accordance with the movement of the carriage 22 during one pass. In the case of FIG. 6, however, since the printing area that is the acquiring range of the detection value "Is" deviates from a range in which detection by the ink sensor 60 is possible, and the CR movement range during one pass is a range that does not pass in front of the ink sensor 60, an appropriate detection value "Is" cannot be acquired in the setting of the normal print process, and the actual ink remaining amount cannot be grasped. In the case of FIG. 6, therefore, the print quality is deteriorated or printing is conducted uselessly due to continuation of the print process after ink runs out unexpectedly, for example. Thus, the ink remaining amount is forcibly detected during printing for one pass by changing various kinds of set values, including the set value of the acquiring range of the detection value "Is", the set value of the movement range of the carriage 22, and the like, as described below in a case such as the case of FIG. 6. This detection of an ink remaining amount is referred to as forcible detection.

When it is determined that the forcible detection execution flag is ON in step 130, it is checked whether the various kinds of set values (such as the set value of the acquiring range of the detection value "Is" or the set value of the movement range of the carriage 22) have been changed or not (step S140). When the set values have not been changed for the forcible detection, a set value changing process is conducted to change the various kinds of set values for the forcible detection (step S150), and subsequently a print process associated with the forcible detection is conducted for one pass (step S160). When the set values have been changed for the forcible detection, a print process associated with the forcible detection is conducted in step S160 without conducting a set value changing process. The details of the set value changing process and the print process associated with the forcible detection will be described later.

On the other hand, when it is determined that the forcible detection execution flag is OFF in step 130, it is checked whether the various kinds of set values have been changed or not as described above (step S170). When the set values have been changed, these are initialized (step S180), and subsequently a normal print process is conducted for one pass (step S190). When the set values have not been changed, a normal print process is conducted for one pass in step S190 without initialization. Here, the set values return to set values for a normal print process by initialization.

When the print process associated with the forcible detection or the normal print process has been conducted, it is determined whether or not there is printing for a next pass (step S200). When there is printing for a next pass, it returns to step S120 and the process is repeated. When there is no printing for a next pass, it moves on to the next process. Hereinafter, ceasing explanations of the main routine, the set value changing process of step S150 and the print process associated with the forcible detection of step S160 will be described in detail.

Figure 7:
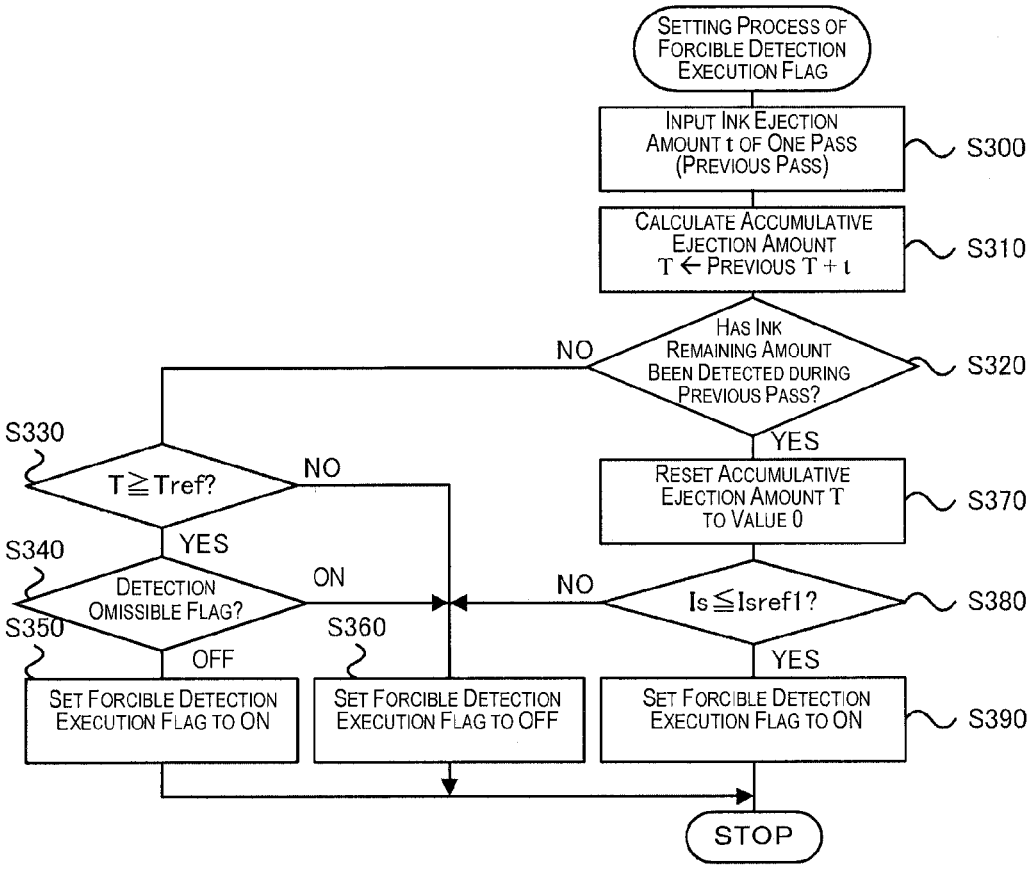
FIG. 7 is a flow chart that shows an example of a setting process of a forcible detection execution flag.

First, the setting process of the forcible detection execution flag will be explained. FIG. 7 is a flow chart that shows an example of the setting process of the forcible detection execution flag conducted by the controller 70. This process is conducted every time either one of the normal print process for one pass or the print process associated with forcible detection for one pass is finished. In this setting process, first, the CPU 72 of the controller 70 inputs an ink ejection amount "t" of one pass whose printing has been finished (pervious pass) (step S300), and calculates a new accumulative ejection amount "T" by adding the input ejection amount "t" to a previous accumulative ejection amount "T" calculated in this process previously conducted (step S310). Here, the ejection amount "t" is calculated, for example, by multiplying the dot number formed during a previous pass by the ink ejection amount per dot. Although the ejection amount "t" and the accumulative ejection amount "T" are values for each color, the explanations will be made without specifically differentiating. Next, it is determined whether or not the ink remaining amount has been detected by the ink sensor 60 during a previous pass (whether or not an appropriate detection value "Is" has been input) (step S320). In the case of FIG. 5 described above, since the detection value "Is" is input for each pass, it is determined that the ink remaining amount has been detected in step S320. In the case of FIG. 6, it is determined that the ink remaining amount has not been detected in step S320 unless an appropriate detection value "Is" is acquired by the forcible detection. Now, targeting at a case in which an ink remaining amount is not detected, the explanations will be made on the case of FIG. 6. Therefore, it is determined that the ink remaining amount has not been detected in step S320, and it moves on to the next process.

In the next process, it is determined whether or not the accumulative ejection amount "T" calculated in step S310 is equal to or greater than a threshold value "Tref" (step S330). Here, the threshold value "Tref" is a value that is determined in advance as an ink amount to be ejected in a case where printing is conducted to the printing area such as FIG. 6 over several passes (for example, five passes or seven passes). When the accumulative ejection amount "T" is equal to or greater than the threshold value "Tref" in at least one color among the ink colors, it is determined that the accumulative ejection amount "T" is equal to or greater than the threshold value "Tref". When it is determined that the accumulative ejection amount "T" is not equal to or greater than the threshold value "Tref", the forcible detection execution flag is set to OFF (step S360), and this process is finished. On the other hand, when it is determined that the accumulative ejection amount "T" is equal to or greater than the threshold value "Tref", ON and OFF of a detection omissible flag set in a process described below are checked (step S340). When the detection omissible flag is OFF, considering that the forcible detection cannot be omitted, the forcible detection execution flag is set to ON (step S350), and this process is finished. On the other hand, the detection omissible flag is ON, considering that the forcible detection can be omitted, the forcible detection execution flag is set to OFF in step S360, and this process is finished.

As described above, in steps S320-S360, when it is determined that a print process has been conducted for several passes in a state where the ink remaining amount is not detected based on the accumulative ejection amount "T", the forcible detection execution flag is set to ON except for the case where the detection omissible flag is ON. Although the reason why the forcible detection can be omitted and the details of the setting of the detection omissible flag are described later, ON and OFF of the detection omissible flag are set before starting printing, the ON and OFF are not changed during printing to one sheet of the paper P. Therefore, in a case where it is determined that the detection omissible flag is OFF in step S340 and the forcible detection execution flag is set to ON in the subsequent step S350, the forcible detection execution flag can be set to ON again during the printing to the paper P.

On the other hand, when it is determined that the ink remaining amount has been detected during a previous pass in step S320, the accumulative ejection amount "T" is reset to a value 0 (step S370), it is determined whether or not the detection value "Is" during the previous pass is equal to or smaller than a threshold value "Isref1" (step S380). Here, the threshold value "Isref1" is set to a value obtained by adding a slight margin to a predetermined ink empty threshold value in which the ink cartridge 26 needs to be replaced. When the detection value "Is" is equal to or smaller than the threshold value "Isref1", the forcible detection execution flag is set to ON (step S390), and this process is finished. On the other hand, when the detection value "Is" exceeds the threshold value "Isref1", the forcible detection execution flag is set to OFF in step S360, and this process is finished.

Here, even in the case of FIG. 6 in which the printing area is limited, if the ink remaining amount is detected by the forcible detection, it is determined that the ink remaining amount has been detected in step S320. In such a case, if the ink remaining amount is sufficient, the necessity for the forcible detection is low until printing is conducted for several passes once again. Therefore, after the accumulative ejection amount "T" is reset to a value 0 in step S370, by setting the forcible detection execution flag to OFF in step S360 if the detection value "Is" is equal to or greater than the threshold value "Isref1" in step S380 and the ink remaining amount is sufficient, it is possible to prevent the forcible detection execution flag from being set to ON again by determining the accumulative ejection amount "T" to be equal to or greater than the threshold value "Tref" in step 330 when a normal print process is conducted for a next pass. Specifically, after the ink remaining amount is detected by the forcible detection, the forcible detection is prevented from being repeatedly conducted. On the other hand, when the ink remaining amount is small to such an extent that the detection value "Is" is equal to or smaller than the threshold value "Isref1" in step S380, it is preferable to continuously monitor the ink remaining amount because it is likely that ink will run out. Therefore, even when the ink remaining amount is detected, in a case where the detection value "Is" is equal to or smaller than the threshold value "Isref1", the forcible detection execution flag is set to ON in step S390. Specifically, in steps S320, S360-S390, basically, the accumulative ejection amount "T" is reset to a value 0 and the forcible detection execution flag is set to OFF so as to prevent the forcible detection from being repeatedly conducted when the ink remaining amount is detected. However, the forcible detection execution flag is set to ON when the ink remaining amount is small. Consequently, since the frequency of conducting the forcible detection can be increased when the ink remaining amount is small, the print quality can be made stable by immediately detecting that it reaches the ink empty threshold value.

Figure 8:
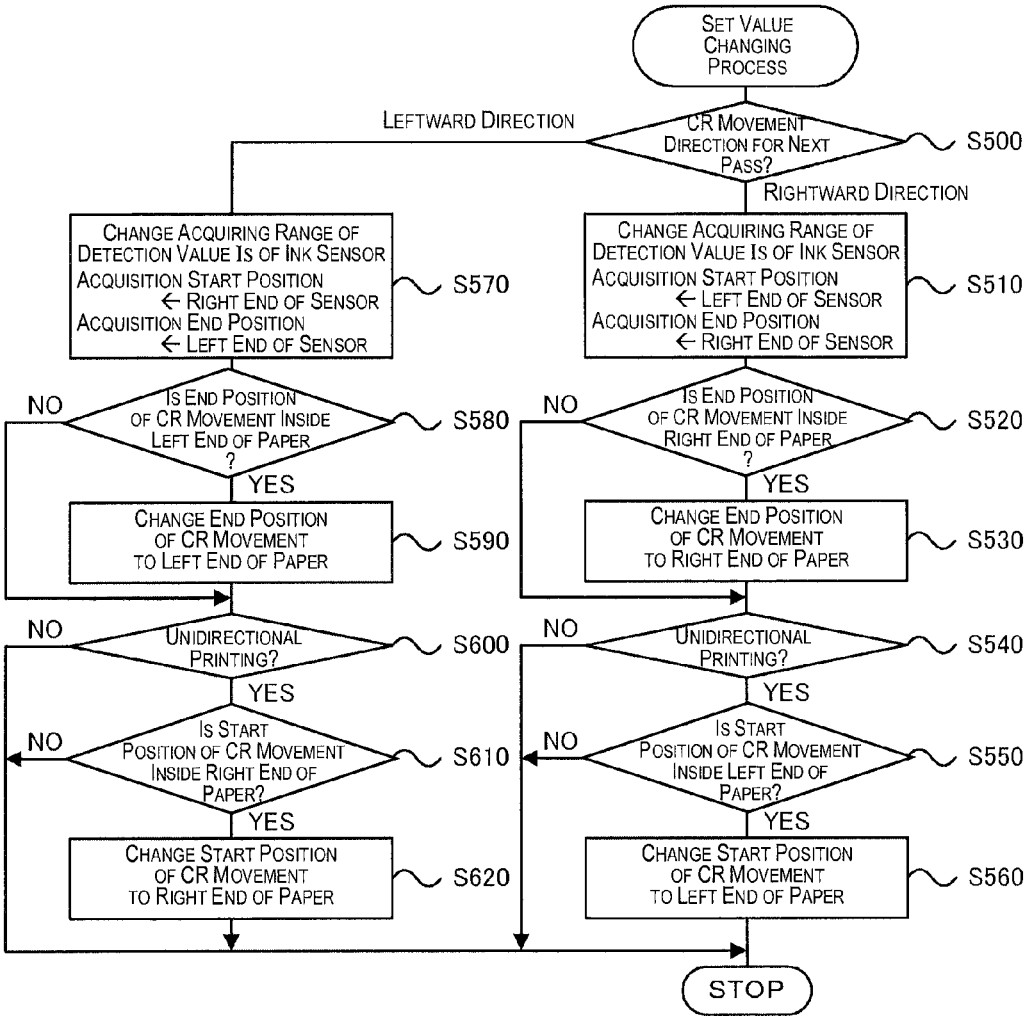
FIG. 8 is a flow chart that shows an example of a set value changing process.
Figure 9:
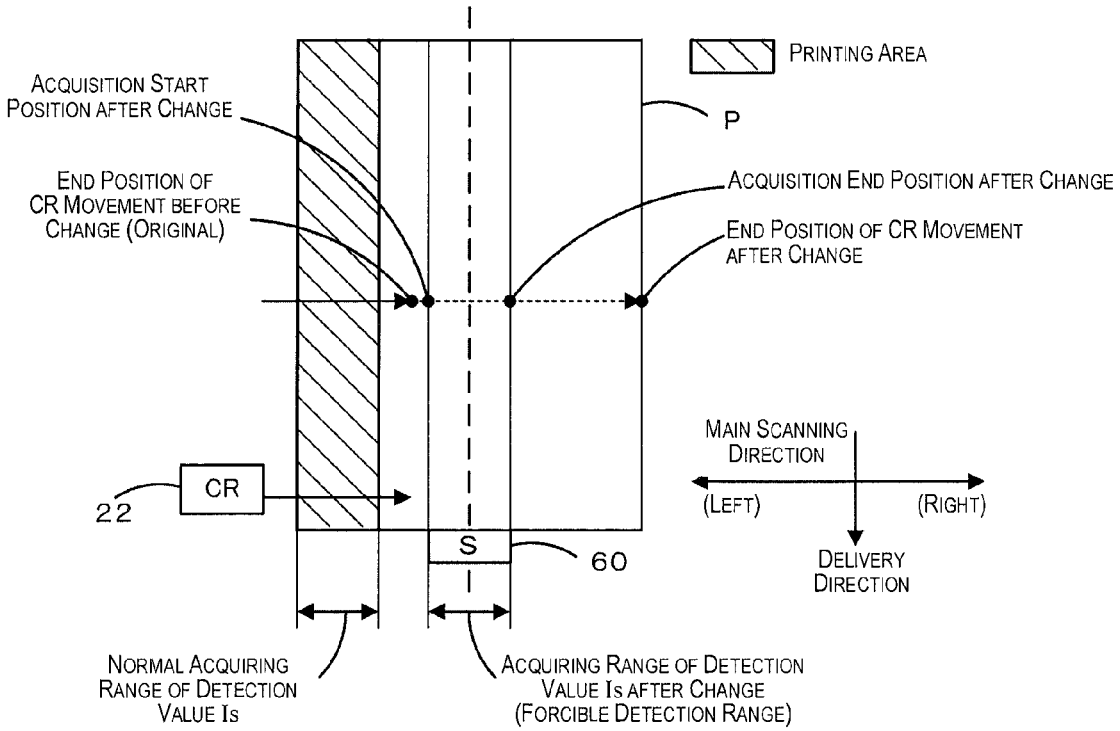
FIG. 9 is a diagram that explains a state of changing a set value.

Next, the set value changing process will be explained. FIG. 8 is a flow chart that shows an example of the set value changing process. FIG. 9 is a diagram that explains a state of changing a set value. FIG. 9 shows an example in which the printing area is limited similarly to FIG. 6. In this changing process, first, the CPU 72 of the controller 70 checks the CR movement direction that is the movement direction (print direction) of the carriage 22 for a next pass (step S500). The CR movement direction is leftward and rightward directions of the main scanning direction in FIG. 9 (the same as in FIG. 2, FIG. 5 and FIG. 6). When it is determined that the CR movement direction is the rightward direction, the acquiring range of the detection value "Is" of the ink sensor 60 is changed accordingly (step S510). Here, the acquiring range of the detection value "Is" is changed from a range for a normal print process (printing area) to a range in which detection of the ink sensor 60 is possible. More specifically, since the CR movement direction is the rightward direction and the carriage 22 moves from the left end side to the right end side of the ink sensor 60, the acquisition start position is set to the position at the left end of the ink sensor 60 and the acquisition end position is set to the position at the right end of the ink sensor 60 (see FIG. 9).

Next, it is determined whether or not the end position of the CR movement is inside the right end of the paper (inside is within the paper, outside is out of the paper) (step S520). As described above, the CR movement range is determined based on a printing area and a range needed for acceleration and deceleration, and the CR movement range is determined from the printing area based on the print data for a next pass in step S520 making the range needed for acceleration and deceleration constant. When the end position of the CR movement is inside the right end of the paper, the end position of the CR movement is changed to the right end of the paper (step S530, see FIG. 9). Consequently, the movement range of the carriage 22 is enlarged so as to increase the likelihood that the carriage 22 passes in front of the ink sensor 60 during one pass. When the end position of the CR movement is not inside the right end of the paper in step S520 or the end position of the CR movement is enlarged in step S530, it is subsequently determined whether or not the current printing is unidirectional printing (step S540). This process is conducted by determining whether the print settings of the ink-jet printer 20 are unidirectional printing or bidirectional printing. When it is determined that the current printing is not unidirectional printing, that is, the current printing is bidirectional printing, the process is finished. When it is determined that the current printing is unidirectional printing, it is determined whether or not the start position of the CR movement is inside the left end of the paper based on the print data (step S550). When the start position of the CR movement is inside the left end of the paper, the start position of the CR movement is changed to the left end of the paper (step S560), and the process is finished. The reason why the start position of the CR movement is changed to the left end of the paper only in the case of unidirectional printing will be described later. Incidentally, since the carriage 22 is already in the start position of the CR movement for a next pass at the time of conducting this changing process, the changed start position of the CR movement will be reflected at the time of starting printing for a pass after the next. On the other hand, even when it is determined that the current printing is unidirectional printing in step S540, if the start position of the CR movement is not inside the left end of the paper in the subsequent step S550, the process is finished.

When it is determined that the CR movement direction for a next pass is the leftward direction in step S500, changing the acquiring range of the detection value "Is", and changing the end position of the CR movement and the start position of the CR movement are conducted in accordance with the leftward direction similarly to the case of the rightward direction. Specifically, the acquiring range of the detection value "Is" is changed by setting the acquisition start position to the right end of the ink sensor 60 and setting the acquisition end position to the left end of the ink sensor 60 (step S570). Also, when the end position of the CR movement is inside the left end of the paper (step S580), the end position of the CR movement is changed to the left end of the paper (step S590). Further, when it is unidirectional printing and the start position of the CR movement is inside the right end of the paper (steps S600, S610), the start position of the CR movement is changed to the right end of the paper (step S620), and the process is finished.

Figure 10:
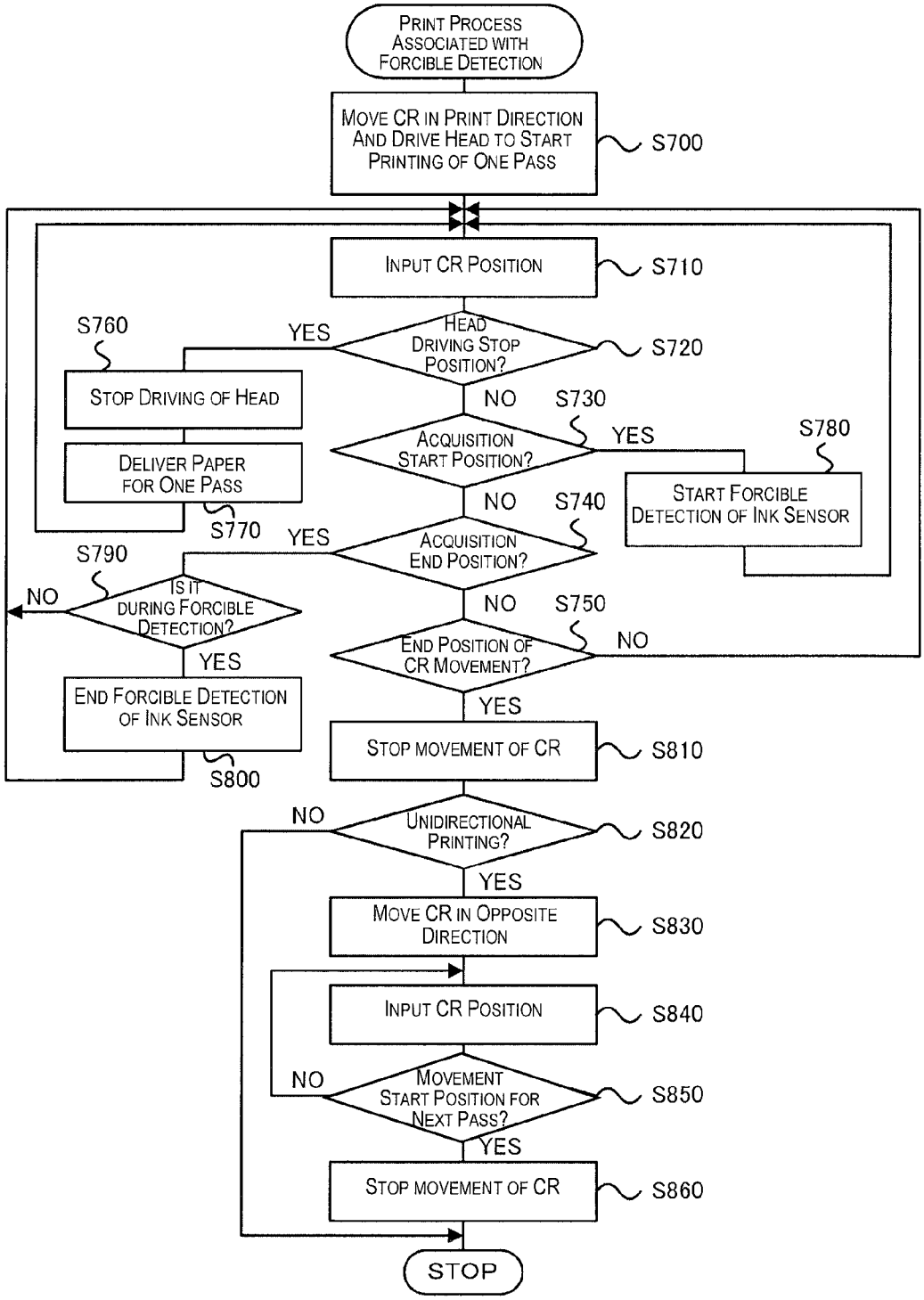
FIG. 10 is a flow chart that shows an example of a print process associated with forcible detection.

Subsequently, the print process associated with the forcible detection will be explained. FIG. 10 is a flow chart that shows an example of the print process associated with the forcible detection. In this print process, first, the CPU 72 of the controller 70 moves the carriage 22 in the print direction (the CR movement direction) and drives the printing head 24 so as to start printing for one pass (step S700). When printing is started, a position signal from the linear encoder 36 is input as a CR position that is the current position of the carriage 22 (step S710), and it is determined whether or not the CR position is a head driving stop position based on the print data (step S720), whether or not the CR position is the acquisition start position changed in the set value changing process of FIG. 8 (step S730), whether or not the CR position is the acquisition end position changed in the same manner (step S740), and whether or not the CR position is the end position of the CR movement (step S750). These processes are repeated until it is determined that the CR position is the end position of the CR movement in step S750.

When the CR position is the head driving stop position in step S720, the driving of the printing head 24 is stopped (step S760), delivery of the paper P for one pass is started by rotating the paper feeding roller 35 at a predetermined amount through driving of the paper feeding motor 33 (step S770), and it returns to step S710 so as to repeat the process. Further, when it is determined that the CR position is the acquisition start position in step S730, acquisition of the detection value "Is" of the ink sensor 60, that is, forcible detection is started (step S780), and it returns to step S710 so as to repeat the process. Further, when it is determined that the CR position is the acquisition end position in step S740, it is determined whether or not it is during the forcible detection (step S790). When it is during the forcible detection, the acquisition of the detection value "Is" of the ink sensor 60, that is, the forcible detection is ended (step S800), and it returns to step S710 so as to repeat the process. When it is not during the forcible detection in step S790, it directly returns to step S710 so as to repeat the process.

Further, when it is determined that the CR position is the end position of the CR movement in step S750, the movement of the carriage 22 is stopped (step S810), and it is determined whether or not the current printing is unidirectional printing (step S820). When it is determined that the current printing is unidirectional printing, the carriage 22 is moved in a direction opposite to the CR movement direction before being stopped (step S830). Then, while inputting the CR position (step S840), it is determined whether or not the CR position is the movement start position (that becomes a movement start position for a next pass) changed in the set value changing process of FIG. 8 (step S850). When it is determined that it is the movement start position for the next pass, the movement of the carriage 22 is stopped (step S860), and the process is finished. With this, the print process associated with the forcible detection (including movement to the movement start position for the next pass in unidirectional printing) is finished. When it is determined that the current printing is not unidirectional printing, that is, the current printing is bidirectional printing, the process is directly finished.

Figure 11A:
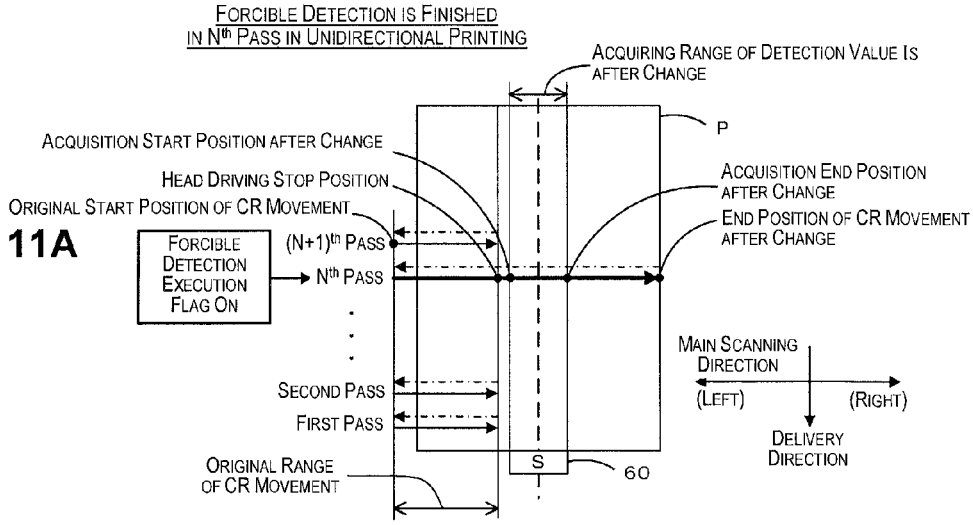
FIGS. 11A and 11B are diagrams that explain an example of a print process associated with forcible detection in unidirectional printing.
Figure 11B:
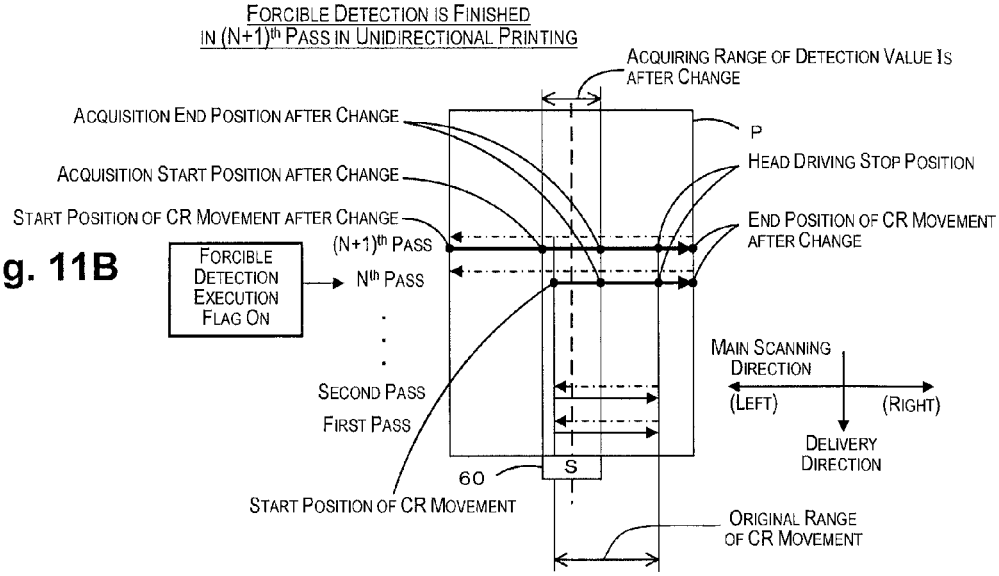
Figure 12A:
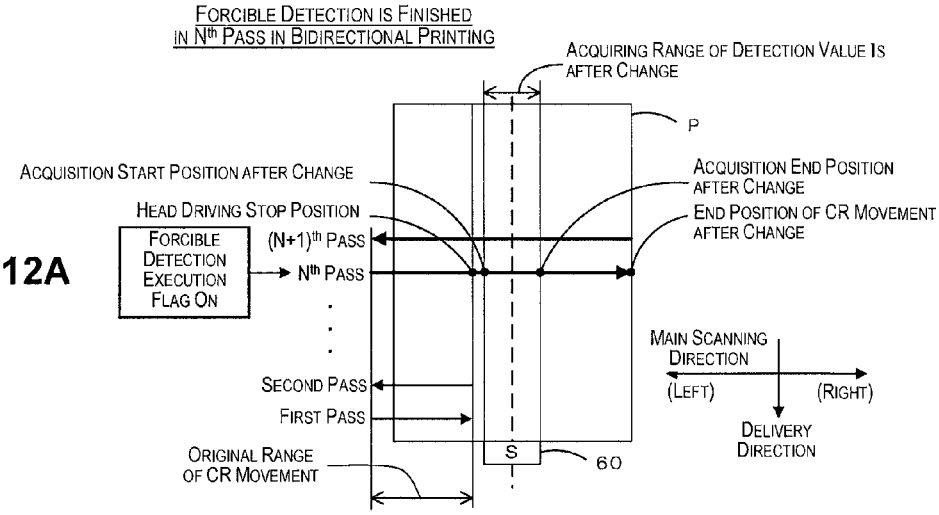
FIGS. 12A and 12B are diagrams that explain an example of a print process associated with forcible detection in bidirectional printing.
Figure 12B:
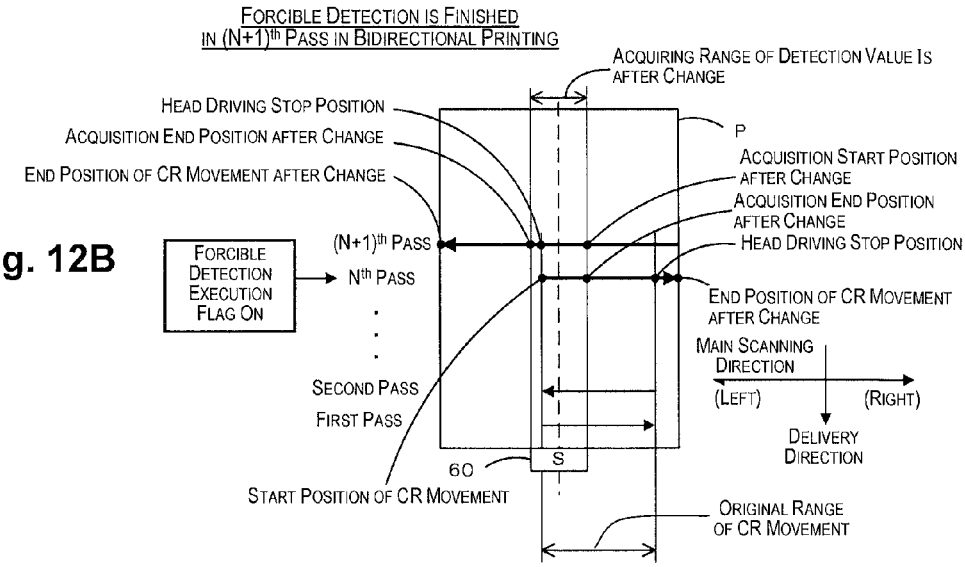
Figure 13A:
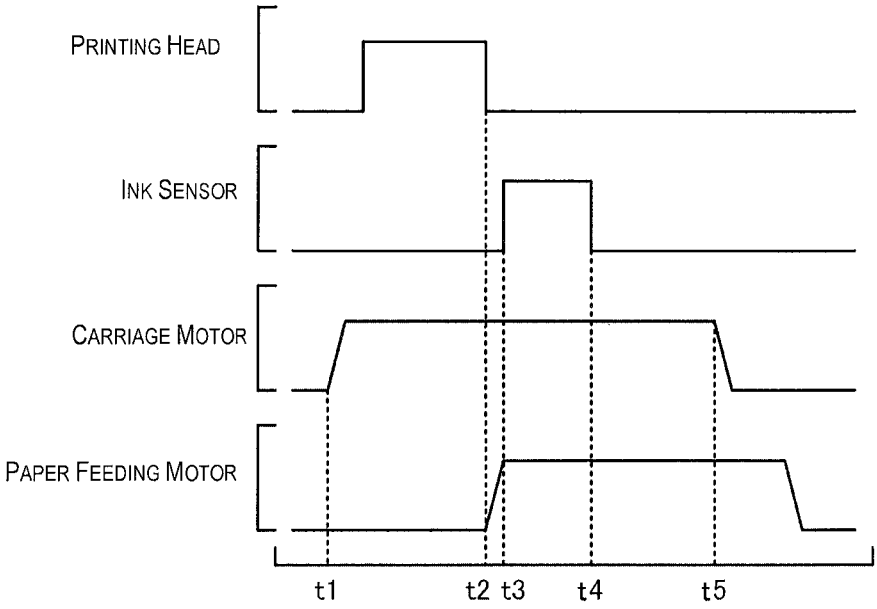
FIGS. 13A and 13B are diagrams that explain a state of change in each operating section over time at the time of a print process associated with forcible detection.
Figure 13B:
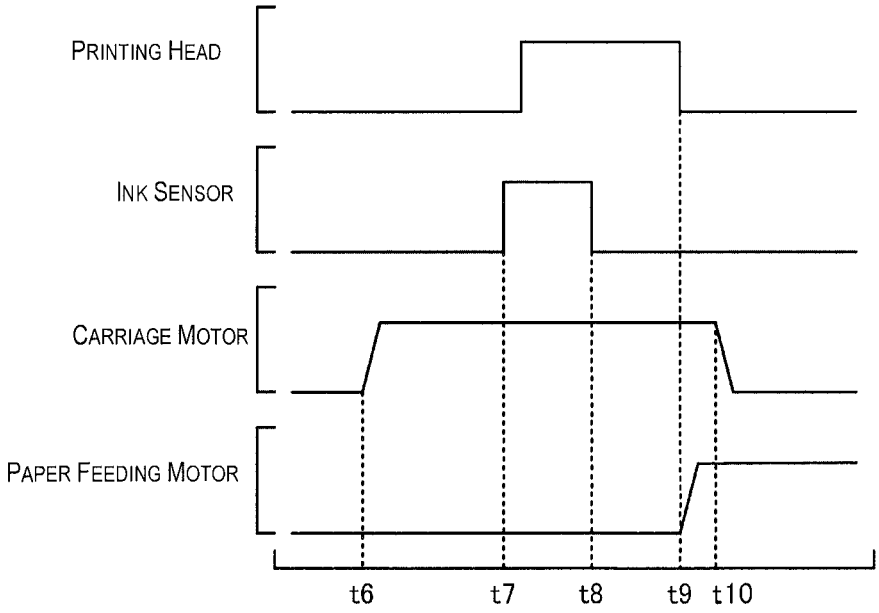

The print process associated with the forcible detection will be explained with reference to the drawings. FIGS. 11A and 11B are diagrams that explain an example of the print process associated with the forcible detection in unidirectional printing. FIGS. 12A and 12B are diagrams that explain an example of the print process associated with the forcible detection in bidirectional printing. FIGS. 13A and 13B are diagrams that explain a state of change in each operating section over time at the time of printing associated with the forcible detection. In both of FIGS. 11A-11B and FIGS. 12A-12B, the forcible detection execution flag is ON before starting printing of an $N^{th}$ pass. In FIG. 11A and FIG. 12A, the forcible detection is finished in the $N^{th}$ pass. In FIG. 11B and FIG. 12B, the forcible detection is not finished in the $N^{th}$ pass, and the forcible detection is finished in the $(N+1)^{th}$ pass. Also, FIG. 13A shows a state of change over time in the $N^{th}$ pass of In FIG. 11A, and FIG. 13B shows a state of change over time in the $(N+1)^{th}$ pass of In FIG. 11B.

In FIG. 11A, when printing of the $N^{th}$ pass is started (time "t1" in FIG. 13A), first, it is determined that the CR position is the head driving stop position, the driving of the printing head 24 is stopped, and delivery of the paper P for one pass is started (time "t2" in FIG. 13A). Next, it is determined that the CR position is the acquisition start position, and the forcible detection is started (time "t3" in FIG. 13A). Subsequently, when it is determined that the CR position is the acquisition end position, the forcible detection is ended (time "t4" in FIG. 13A) because it is during the forcible detection. In this manner, the forcible detection can be ended in the $N^{th}$ pass in which the forcible detection execution flag is ON. Also, as shown in FIG. 13A, since delivery of the paper P for one pass is started at the timing when the driving of the printing head 24 is stopped, the delivery of the paper P and the forcible detection (the movement of the carriage 22 for the forcible detection) can be conducted at the same time. Therefore, compared to one in which the delivery is started after the carriage 22 (carriage motor 34*a*) is stopped, the print process associated with the forcible detection can be efficiently conducted, and the throughput of the printing can be prevented from being greatly deteriorated. Then, it is determined that the CR position is the end position of the CR movement, and the movement of the carriage 22 is stopped (time "t5" in FIG. 13A). Since it is unidirectional printing, the carriage 22 is moved to the start position of the CR movement, and thereafter the print process associated with the forcible detection is finished. In FIG. 11A, since the start position of the CR movement is outside the left end of the paper and the start position of the CR movement has not been changed, the CR position returns to the original start position of the CR movement. Also, by finishing the forcible detection, the forcible detection execution flag is set to OFF in the setting process of the forcible detection execution flag of FIG. 7 except for a case where the ink remaining amount is small. Therefore, a normal print process for one pass is conducted in the next $(N+1)^{th}$ pass.

In FIG. 11B, since the start position of the CR movement for the $N^{th}$ pass is already in the acquisition start position unlike in FIG. 11A, even when printing of the $N^{th}$ pass is started, it is not determined that the CR position is the acquisition start position, and the forcible detection is not started. Therefore, it is first determined that the CR position is the acquisition end position. However, since it is not during the forcible detection, the process of ending the forcible detection is not conducted. Thus, the forcible detection cannot be finished in the $N^{th}$ pass in which the forcible detection execution flag is ON. Next, it is determined that the CR position is the head driving stop position, the driving of the printing head 24 is stopped, and the paper P is delivered for one pass. Then, it is determined that the CR position is the end position of the CR movement, and the movement of the carriage 22 is stopped. Since it is unidirectional printing, the carriage 22 is moved to the start position of the CR movement, and thereafter the print process associated with the forcible detection is finished once. In FIG. 11B, since the start position of the CR movement is inside the left end of the paper P and the start position of the CR movement has been changed to the left end of the paper P, the CR position returns to the start position of the CR movement that has been changed. Also, since the forcible detection is not finished, the forcible detection execution flag is set to ON again in the setting process of the forcible detection execution flag of FIG. 7. Therefore, the print process associated with the forcible detection is conducted again in the next $(N+1)^{th}$ pass. In the $(N+1)^{th}$ pass, the carriage 22 starts moving from the start position of the CR movement that has been changed. Therefore, printing of the $(N+1)^{th}$ pass is started (time "t6" in FIG. 13B). Then, first, it is determined that the CR position is the acquisition start position, and the forcible detection is started (time "t7" in FIG. 13B). Next, when it is determined that the CR position is the acquisition end position, the forcible detection is ended (time "t8" in FIG. 13B) because it is during the forcible detection. In this manner, the forcible detection can be ended in the $(N+1)^{th}$ pass. Subsequently, it is determined that the CR position is the head driving stop position, the driving of the printing head 24 is stopped, and the paper P is delivered for one pass (time "t9" in FIG. 13B). Then, it is determined that the CR position is the end position of the CR movement, and the movement of the carriage 22 is stopped (time "t10" in FIG. 13B). Since the subsequent processes are similar to those of the $N^{th}$ pass, the explanations will be omitted. As described above, in the next $N^{th}$ pass, the carriage 22 is moved to the start position of the CR movement that has been changed. In the $(N+1)^{th}$ pass, the carriage 22 starts moving from the start position of the CR movement that has been changed. Therefore, even in a case where it has already passed the acquisition start position such as a case where the original start position of the CR movement is within the acquiring range of the detection value "Is", the forcible detection can be finished in the $(N+1)^{th}$ pass. This is the reason why the start position of the CR movement is changed in the case of unidirectional printing in steps S540-S560 and S600-S620 of the set value changing process of FIG. 8.

In FIG. 12A, similarly to FIG. 11A, since the forcible detection can be finished in the $N^{th}$ pass, the explanations will be omitted. Also, in FIG. 12B, similarly to FIG. 11B, since the forcible detection cannot be started in the $N^{th}$ pass, the print process associated with the forcible detection is conducted again in the next $(N+1)^{th}$ pass. Since it is bidirectional printing in FIG. 12B, printing is started using the end position of the CR movement that has been changed in the $N^{th}$ pass as the start position of the CR movement in the $(N+1)^{th}$ pass. Therefore, in printing for the $(N+1)^{th}$ pass, it is first determined that the CR position is the acquisition start position, and the forcible detection can be started. Next, it is determined that the CR position is the head driving stop position, the driving of the printing head 24 is stopped, and the paper P is delivered for one pass. Subsequently, when it is determined that the CR position is the acquisition end position, the forcible detection is ended because it is during the forcible detection. Then, it is determined that the CR position is the end position of the CR movement, and the movement of the carriage 22 is stopped. As described above, the carriage 22 is moved to the end position of the CR movement that has been changed in the $N^{th}$ pass, and the carriage 22 starts moving using the end position of the CR movement as the start position of the CR movement in the next $(N+1)^{th}$ pass. Therefore, even in a case where the original start position of the CR movement has already passed the acquisition start position, the forcible detection can be finished in the $(N+1)^{th}$ pass in the same manner as in FIG. 11B. Therefore, since the end position of the CR movement becomes the start position of the CR movement in the next pass in bidirectional printing, it is sufficient to change the end position of the CR movement unlike the case of unidirectional printing. This is the reason why the processes of steps S540-S560 and S600-S620 are omitted in the set value changing process of FIG. 8 in the case of bidirectional printing.

As described above, in the examples of FIGS. 11A-11B and FIGS. 12A-12B, the forcible detection execution flag is set to ON before starting printing of an $N^{th}$ pass, and thereafter the forcible detection can be finished in the $N^{th}$ pass or in the $(N+1)^{th}$ pass. Specifically, the forcible detection can be finished within two passes after the forcible detection execution flag is set to ON. It is thus possible to prevent problems from being caused by a situation in which the ink remaining amount is continuously not detected. Also, in bidirectional printing, the forcible detection can be conducted by uniformly changing the acquiring range of the detection value "Is" and the end position of the CR movement before printing. In unidirectional printing, the forcible detection can be conducted by uniformly changing the acquiring range of the detection value "Is", the end position of the CR movement and the start position of the CR movement before printing. In this manner, the forcible detection can be conducted with a relatively simple process. Here, it might be possible to change the end position of the CR movement and the start position of the CR movement during printing as needed instead of uniformly changing the end position of the CR movement and the start position of the CR movement before printing. For example, it might be possible to decelerate the carriage 22 as usual at a timing when the driving of the printing head 24 is stopped during printing of the $N^{th}$ pass, determine whether or not the forcible detection is finished at that timing, and immediately stop the carriage 22 in a case where the forcible detection is finished, or change the end position of the CR movement and stop the carriage 22 after moving the carriage 22 to the changed position in a case where the forcible detection is not finished. However, changing at such a timing makes the process complicated or causes repetition of deceleration (halt) and acceleration of the carriage 22. As a result, there is a possibility that the motion of the carriage 22 becomes unusual and the ink remaining amount cannot be stably detected. In the present embodiment, therefore, it is configured that the motion of the carriage 22 is made stable during the forcible detection and the ink remaining amount can be detected more securely by uniformly changing the end position of the CR movement or the start position of the CR movement before starting printing in the set value changing process of FIG. 8.

Figure 14:
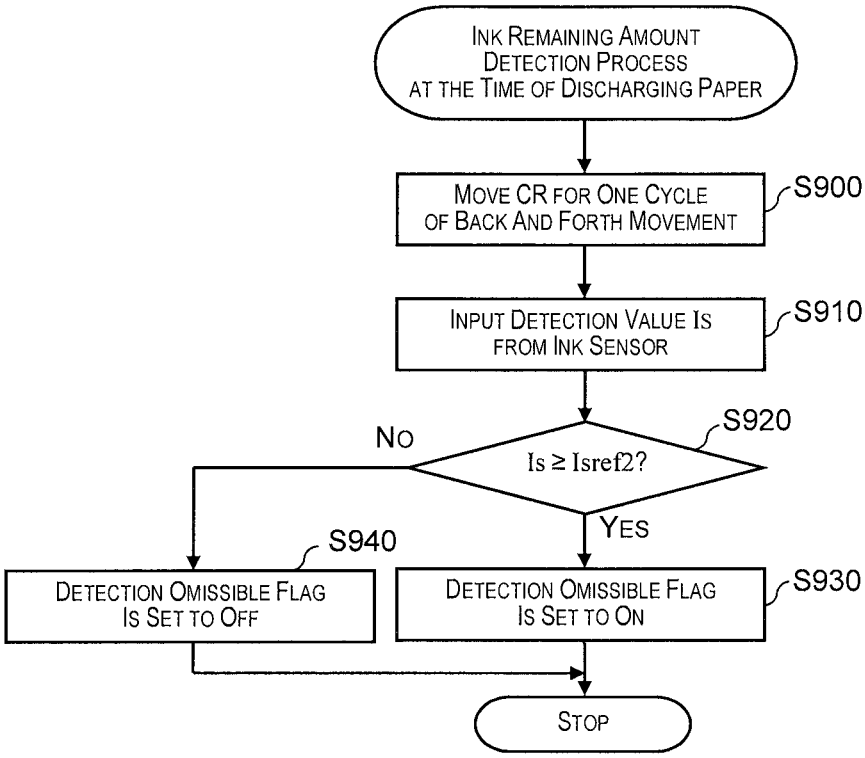
FIG. 14 is a flow chart that shows an example of an ink remaining amount detection process at the time of discharging paper.

Back to the main routine of FIG. 4, when a print process for one pass is conducted as described above, and it is determined that there is no printing for a next pass in step S200, a paper discharging process is conducted to discharge the paper P (step S210), an ink remaining amount detection process at the time of discharging paper is conducted (step S220), and this routine is finished. The above-described detection omissible flag is set in this ink remaining amount detection process at the time of discharging paper. Hereinafter, the ink remaining amount detection process at the time of discharging paper will be explained. FIG. 14 is a flow chart that shows an example of the ink remaining amount detection process at the time of discharging paper.

In this ink remaining amount detection process at the time of discharging paper, first, the CPU 72 of the controller 70 moves the carriage 22 for one cycle of back and forth movement (step S900), and inputs the detection value "Is" from the ink sensor 60 (step S910). It is sufficient for the one cycle of back and forth movement to be one that allows the carriage 22 to pass in front of the ink sensor 60 so as to acquire an appropriate detection value "Is". For example, the carriage 22 can move from the end position of the CR movement for a previous pass to the flushing region 54 in the forward movement, and can move to the home position in the backward movement. Next, it is determined whether or not the input detection value "Is" is equal to or greater than a threshold value "Isref2" (step S920). The threshold value "Isref2" is set as a threshold value in which it is assumed that the ink remaining amount is sufficient to such an extent that the ink remaining amount after finishing printing for one sheet of the paper P clearly does not reach the above-described threshold value "Isref1" even in a case where printing is conducted to the printing area limited as in FIG. 6 or FIG. 9. When the detection value "Is" is equal to or greater than the threshold value "Isref2" in step S920, the detection omissible flag is set to ON (step S930), and this process is finished. On the other hand, when the detection value "Is" is not equal to or greater than the threshold value "Isref2" in step S920, the detection omissible flag is set to OFF (step S940), and this process is finished.

In this manner, when it is determined that the ink remaining amount is sufficient in this ink remaining amount detection process at the time of discharging paper, the detection omissible flag is set to ON. Consequently, the forcible detection execution flag will not be set to ON even if the accumulative ejection amount "T" is equal to or greater than the threshold value "Tref" in the setting process of the forcible detection execution flag of FIG. 7 during printing of the paper P fed next. Therefore, the throughput of the printing can be prevented from being deteriorated by conducting the print process associated with the forcible detection in a case where there is no need to detect an ink remaining amount because the ink remaining amount is sufficient. This is the reason why the forcible detection execution flag will not be set to ON even if the accumulative ejection amount "T" is equal to or greater than the threshold value "Tref" if the detection omissible flag is ON in the setting process of the forcible detection execution flag of FIG. 7.

Here, the correspondence relationship between the elements of the present embodiment and the elements of the invention are explained. The printing head 24 of the present embodiment corresponds to the "printing head". The ink cartridge 26 corresponds to the "ink cartridge". The carriage 22 corresponds to the "carriage". The carriage belt 32, the carriage motor 34*a*, and the driven roller 34*b* which move the carriage 22 correspond to the "moving section". The ink sensor 60 corresponds to the "ink remaining amount detecting section". The controller 70 which conducts the setting process of the forcible detection execution flag of FIG. 7 and the ink remaining amount detection process at the time of discharging paper of FIG. 14 corresponds to the "remaining amount detection requesting section". The controller 70 which conducts the main routine of FIG. 4, the set value changing process of FIG. 8, and the print process associated with the forcible detection of FIG. 10 corresponds to the "print processing section".

With the ink-jet printer 20 of the present embodiment described above in detail, the print process associated with the forcible detection is conducted in which the movable range of the carriage 22 is enlarged to a range that makes detection of an ink remaining amount by the ink sensor 60 possible, and the printing head 24 and the carriage motor 34*a* are controlled such that the printing head 24 ejects ink while the carriage 22 is moving in the enlarged movable range in a case where the forcible detection execution flag is set to ON. Consequently, in a case where the forcible detection is requested, the ink remaining amount in the ink cartridge 26 can be detected regardless of the printing area based on the print data. As a result, even in a case where the printing area deviates from the range in which detection by the ink sensor 60 is possible, the ink remaining amount can be detected.

Also, since the delivery of the paper P for one pass is started at the timing when the driving of the printing head 24 is stopped, the print process associated with the forcible detection can be efficiently conducted, and the throughput of the printing can be prevented from being greatly deteriorated. Further, in a case where the detection value "Is" is equal to or smaller than the threshold value "Isref1" and the ink remaining amount is small, the frequency of conducting the forcible detection can be increased and thus the print quality can be made stable. Further, the throughput of the printing can be prevented from being deteriorated by conducting the print process associated with the forcible detection because the forcible detection is not conducted in a case where the detection value "Is" is equal to or greater than the threshold value "Isref2" and there is no need to detect the ink remaining amount. Further, the forcible detection is conducted by uniformly changing the acquiring range of the detection value "Is" and the end position of the CR movement before printing in bidirectional printing, and by uniformly changing the acquiring range of the detection value "Is", the end position of the CR movement and the start position of the CR movement before printing in unidirectional printing. Therefore, the motion of the carriage 22 is made stable during the forcible detection, and the ink remaining amount can be detected more securely. Further, the ink sensor 60 is arranged in a substantially central position of the paper P regardless of the size of the paper P, and the likelihood of detecting the ink remaining amount in a normal print process is increased. Therefore, the frequency of conducting the print process associated with the forcible detection can be made low.

The invention is not limited to the present embodiment described above at all. It is apparent that the invention can be implemented as various embodiments as long as they belong to the technical scope of the invention.

In the above-described embodiment, in the print process associated with the forcible detection, when the driving of the printing head 24 is stopped, the delivery of the paper P for one pass is started by driving the paper feeding motor 35. In other words, the paper P is delivered while the carriage 22 is moving for the forcible detection. However, the invention is not limited to this. It can be configured that the paper P is not delivered while the carriage 22 is moving for the forcible detection, and the paper P is delivered after the carriage 22 is stopped in the end position of the CR movement. Here, in view of the throughput of the printing, it is usually preferable that the paper P is delivered while the carriage 22 is moving for the forcible detection. However, in a limited printing area that needs the forcible detection, since printing is conducted to a region narrower than usual, the original throughput of the printing is relatively high, and there is a tendency that the drying time to dry ink ejected toward the paper P between passes becomes short. Therefore, by delivering the paper P after the movement of the carriage 22 is stopped, it is possible to achieve the effect that the drying time between passes can be secured. Incidentally, securing the drying time is especially effective in both side printing in which the printing area overlaps between printing of the front side and printing of the back side.

In the above-described embodiment, the conditions for setting the forcible detection execution flag to ON are that the accumulative ejection amount "T" is equal to or greater than the threshold value "Tref" in a state where detection of the ink remaining amount by the ink sensor 60 is not detected. However, the invention is not limited to this. The forcible detection execution flag can be set to ON under other conditions. For example, the ink remaining amount detected by the ink sensor 60 is renewed as an actual measurement remaining amount every time it is detected during printing of one pass, and the ink remaining amount calculated using a calculational ejection amount ejected from the printing head 24 is renewed as a calculated remaining amount every time printing of one pass is finished. The forcible detection execution flag can be set to ON when the difference between the actual measurement remaining amount and the calculated remaining amount becomes equal to or greater than a predetermined value, and the forcible detection execution flag can be set to OFF when the difference becomes smaller than the predetermined value. Alternatively, ON and OFF of the forcible detection execution flag can be set by analyzing the print data. For example, the print data up to a predetermined number of passes away is analyzed, and the forcible detection execution flag can be set to ON when it is determined that the ink remaining amount is not detected up to the predetermined number of passes away from the printing area.

In the above-described embodiment, ON and OFF of the detection omissible flag are set by the ink remaining amount detection process at the time of discharging paper in which the ink remaining amount is detected during discharging of the paper P. However, the invention is not limited to this. It is sufficient that ON and OFF of the detection omissible flag are set by detecting the ink remaining amount from the time previous printing of the paper P is finished until next printing of the paper P is started. For example, ON and OFF of the detection omissible flag can be set by detecting the ink remaining amount during feeding of the paper P. Alternatively, the invention is not limited to one in which the detection omissible flag is used, and the detection omissible flag can not be used. In such a case, for example, the forcible detection execution flag can be set to ON always when the accumulative ejection amount "T" becomes equal to or greater than the threshold value "Tref" in step S330 of the setting process of the forcible detection execution flag of FIG. 7 by omitting step S220 of FIG. 4 (the ink remaining amount detection process at the time of discharging paper of FIG. 14).

In the above-described embodiment, in the setting process of the forcible detection execution flag of FIG. 7, the forcible detection execution flag is set to ON always when the detection value "Is" is equal to or smaller than the threshold value "Isref1". However, the invention is not limited to this, and any configuration is possible as long as the frequency of the forcible detection is increased when the ink remaining amount is small. For example, in a case where the detection value "Is" is equal to or smaller than a certain threshold value, the accumulative ejection amount "T" is compared with a threshold value smaller than the threshold value "Tref", and the forcible detection execution flag can be set to ON when the accumulative ejection amount "T" exceeds the threshold value. Further, the invention is not limited to one in which the frequency of the forcible detection is increased, and the frequency of the forcible detection can not be changed. In such a case, the forcible detection execution flag can be set to OFF in step S360 by omitting the processes of steps S380-step S390 in the setting process of the forcible detection execution flag of FIG. 7.

In the above-described embodiment, when the acquiring range of the detection value "Is" of the ink sensor 60 is changed in step S510 and step S570 in the set value changing process of FIG. 8, the right and left ends of the ink sensor 60 are set without considering a margin. However, the invention is not limited to this, and a margin can be considered. For example, considering a margin a with respect to the positions of the right and left ends of the ink sensor 60, in a case where the movement direction of the carriage 22 is the rightward direction, the acquisition start position can be set in a position on a near side of the movement direction by the value a from the left end of the ink sensor 60, and the acquisition end position can be set in a position on a far side of the movement direction by the value a from the right end of the ink sensor 60.

In the above-described embodiment, the acquiring range of the detection value "Is" of the ink sensor 60 is normally set to the printing area, and changed to both ends of the ink sensor 60 in the set value changing process for the forcible detection. However, the invention is not limited to this, and the acquiring range of the detection value "Is" can be normally set to both ends of the ink sensor 60. In such a case, the processes of step S510 and step S570 in the set value changing process of FIG. 8 can be omitted.

In the above-described embodiment, it is determined whether or not the ink remaining amount has been detected during the previous pass in the process of step S320 in the setting process of the forcible detection execution flag of FIG. 7. However, the invention is not limited to this, and determination can be made including a case where the ink remaining amount has been detected in accordance with the movement of the carriage 22 after the previous pass is finished. For example, in a case where the carriage 22 moves to the flushing region 54 for flushing after the pervious pass is finished, it can be determined that detection occurred if the ink remaining amount was detected during the movement. With this, the frequency of conducting the print process associated with the forcible detection can be made low, and the throughput of the printing can be prevented from being deteriorated by the forcible detection.

In the above-described embodiment, the paper P is delivered by so-called center paper feeding. However, the invention is not limited to this, and the paper P can be delivered by so-called one-sided paper feeding that uses an end portion of one side of the paper P in the main scanning direction as the reference. In such a case, the invention is not limited to one in which the ink sensor 60 is disposed in the center of the paper P of the smallest size. The ink sensor 60 can be disposed in a position slightly inside the end portion of one side that is the reference of the delivery of the paper P.

In the above-described embodiment, the ink sensor 60 is disposed in the center of the paper P of the smallest size. However, the invention is not limited to this, and the ink sensor 60 can be disposed within the width of the paper P of the smallest size in the main scanning direction.

In the above-described embodiment, the printing area limited to part of the paper P is an area of a predetermined width. However, the invention is not limited to this, and it can be a printing area that is different in the width or the position for each pass.

In the above-described embodiment, an example of the ink-jet printer 20 was described as the printing device of the invention. However, the invention is not limited to this, and for example, the invention can be applied to a facsimile device or a multi-purpose device other than a printer as long as printing is conducted by ejecting ink from a printing head to a medium based on print data.

What is claimed is:

1. A printing device, in which printing is conducted by ejecting ink from a printing head to a medium based on print data, comprising:

a carriage that installs the printing head and an ink cartridge for storing ink;

a moving section that moves the carriage in a main scanning direction;

an ink remaining amount detecting section that can detect an ink remaining amount in the ink cartridge when the carriage moves in a part of a movable range of the carriage in the main scanning direction, the ink remaining amount detecting section being provided spaced apart from the carriage in the movable range of the carriage in the main scanning direction;

a remaining amount detection requesting section that makes a request for detection of an ink remaining amount in the ink cartridge by the ink remaining amount detecting section in a case where predetermined detection conditions are met; and a print processing section that conducts a print process for detection of an ink remaining amount in which the movable range of the carriage in the main scanning direction based on the print data is enlarged to a range including the part of the movable range so as to make detection of an ink remaining amount possible, and the printing head and the moving section are controlled such that the printing head ejects ink while the carriage is moving in the enlarged movable range in a case where a request for detection of an ink remaining amount is made.

2. The printing device according to claim 1, further comprising:

a delivering section that delivers the medium in a sub scanning direction, wherein, when ejection of ink from the printing head is finished in a predetermined print pass, the print processing section controls the delivering section so as to deliver the medium for a next print pass even while the carriage is moving.

3. The printing device according to claim 1, wherein the remaining amount detection requesting section makes a request for detection of an ink remaining amount by determining that the predetermined detection conditions are met in a case where a predetermined number of print passes are continued in a state where detection of an ink remaining amount by the ink remaining amount detecting section is not conducted.

4. The printing device according to claim 1, wherein the remaining amount detection requesting section increases frequency of making a request for detection of an ink remaining amount in a case where the ink remaining amount detected by the ink remaining amount detecting section is below a predetermined threshold value.

5. The printing device according to claim 1, wherein the print processing section controls the moving section such that the carriage moves at least in the part of the movable range at a predetermined timing from completion of printing to a previous medium until start of printing to a next medium, and the remaining amount detection requesting section stops a request for detection of an ink remaining amount during the printing to a next medium regardless of whether the predetermined detection conditions are met or not when it is expected that the ink remaining amount will not fall below a predetermined threshold value during the printing to a next medium based on the ink remaining amount detected by the ink remaining amount detecting section at the predetermined timing.

6. The printing device according to claim 1, wherein the remaining amount detection requesting section cancels a request for detection of an ink remaining amount in a case where the ink remaining amount is detected by the ink remaining amount detecting section after the request is made, and the print processing section conducts control of printing for detection of an ink remaining amount by enlarging the movable range of the carriage in a print pass to a range including the part of the movable range until a request for detection of an ink remaining amount is cancelled in a case where the request is made in bidirectional printing.

7. The printing device according to claim 1, wherein the remaining amount detection requesting section cancels a request for detection of an ink remaining amount in a case where the ink remaining amount is detected by the ink remaining amount detecting section after the request is made, and the print processing section conducts control of printing for detection of an ink remaining amount by enlarging the movable range of the carriage in a print pass to a range including the part of the movable range until a request for detection of an ink remaining amount is cancelled in a case where the request is made in unidirectional printing.

8. The printing device according to claim 1, which can conduct printing to a plurality of kinds of mediums having different sizes, wherein the ink remaining amount detecting section is provided in a position that is a substantially central position in the main scanning direction of a medium having the smallest width in the main scanning direction among the plurality of kinds of mediums.

9. The printing device according to claim 1, wherein the ink remaining amount detecting section detects the ink remaining amount when the carriage moves for flushing.

10. A method for controlling a printing device comprising a carriage that installs a printing head and an ink cartridge for storing ink, a moving section that moves the carriage in a main scanning direction, and an ink remaining amount detecting section that can detect an ink remaining amount in the ink cartridge when the carriage moves in a part of a movable range of the carriage in the main scanning direction, the ink remaining amount detecting section being provided spaced apart from the carriage in the movable range of the carriage in the main scanning direction, in which printing is conducted by ejecting ink from the printing head to a medium based on print data, the method comprising:

making a request for detection of an ink remaining amount in the ink cartridge by the ink remaining amount detecting section in a case where predetermined detection conditions are met; and conducting a print process for detection of an ink remaining amount in which the movable range of the carriage in the main scanning direction based on the print data is enlarged to a range including the part of the movable range so as to make detection of an ink remaining amount possible, and the printing head and the moving section are controlled such that the printing head ejects ink while the carriage is moving in the enlarged movable range in a case where a request for detection of an ink remaining amount is made by the making the request.

* * * * *